US007799978B2

(12) United States Patent
Nagakura et al.

(10) Patent No.: US 7,799,978 B2
(45) Date of Patent: Sep. 21, 2010

(54) TUNER MOUNTING DEVICE

(75) Inventors: Fumiyoshi Nagakura, Chiba (JP); Hirokazu Serita, Chiba (JP); Akiko Asahata, Chiba (JP); Tomotada Ishii, Chiba (JP)

(73) Assignee: Seiko Instruments Inc. (JP)

( * ) Notice: Subject to any disclaimer, the term of this patent is extended or adjusted under 35 U.S.C. 154(b) by 9 days.

(21) Appl. No.: 12/378,189

(22) Filed: Feb. 11, 2009

(65) Prior Publication Data

US 2009/0235807 A1 Sep. 24, 2009

(30) Foreign Application Priority Data

Feb. 18, 2008 (JP) ..... 2008-036430

(51) Int. Cl.
*G10D 3/00* (2006.01)

(52) U.S. Cl. ..... 84/312 R

(58) Field of Classification Search ..... 84/327, 84/312 R, 454
See application file for complete search history.

(56) References Cited

U.S. PATENT DOCUMENTS 6,176,066 B1 * 1/2001 Ong et al. ..... 53/399
2004/0123723 A1 * 7/2004 Hurwicz ..... 84/454

* cited by examiner

*Primary Examiner*—Kimberly R Lockett
(74) *Attorney, Agent, or Firm*—Adams & Wilks

(57) ABSTRACT

A tuner mounting mounts a tuner to a musical instrument to indicate a tuning state of the musical instrument. The tuner mounting device has a hook-and-loop fastener that connects to a main body of the tuner and is configured to wrap directly around at least a part of the instrument so that end portions of the hook-and-loop fastener are removably connected to one another to directly mount the tuner main body to the part of the instrument.

20 Claims, 14 Drawing Sheets

TUNER MOUNTING DEVICE

BACKGROUND OF THE INVENTION

1. Field of the Invention

The present invention relates to a tuner mounting device for mounting a tuner to a musical instrument.

2. Description of the Related Art

As a mounting device for a conventional tuner which is directly mounted to an instrument, and which displays the tuning state of a sound generated from the instrument on a display portion, there has widely been adopted a clip type device which is mainly of a clothespin-like configuration (see, for example, JP 2003-255932 A).

A tuner of this type has in its main body a vibration sensor and a microphone as main input devices.

In many cases a generally used clip type tuner has a joint-like structure in a connecting portion between the clip portion and the main body portion.

This is due to the necessity to direct the display portion such that it is easily visible to the user when the clip is mounted to the instrument. In many cases, such a clip type tuner has a joint mechanism of two or more axes.

As illustrated in FIG. 25, a clip-type tuner is mounted to a part of an instrument 600 by the grasping force of a clip 100 connected to a tuner main body.

The clip 100 includes a pair of arms 101 and 102 having grasping portions 103 and 104 on the inner sides of the respective distal end portions thereof, and an opening/closing portion 105 containing an elastic member such as a spring urging the pair of arms 101 and 102 so as to close the distal end portions of the pair of arms 101 and 102.

Since the instrument part (e.g., head portion of a guitar) 600 is held between the distal end portions of the arms 101 and 102 by the urging force of the elastic member (not shown) constituting the opening/closing portion 105 of the clip 100, when the instrument part 600 is inserted to a position where it is brought into contact with the opening/closing portion 105, which is a hard structure situated at the depth of the clip, with the distal end portions of the arms 101 and 102 of the clip 100 being open, there is a risk that the instrument is scratched.

In order that the instrument to which the tuner is mounted may not easily be scratched, the grasping portions 103 and 104 provided on the inner sides of the distal end portions of the pair of arms 101 and 102 of the clip 100 are often formed of a soft material such as rubber.

When, for example, rubber is used as the material of the grasping portions 103 and 104, there is a risk that the rubber is allowed to be rubbed off on the instrument depending upon the kind of rubber, thus staining the expensive instrument.

Further, in the case of the clip-type instrument, it cannot be mounted to a large object whose side is beyond the movable range of the opening/closing portion 105 of the clip. As illustrated in FIG. 26, in the case, in particular, of a fat-tube instrument like a bass instrument, the mounting of the tuner to a fat tube portion 601 may be rather difficult to perform.

Many generally used clip-type tuners have a joint mechanism of two axes or more, and contain a vibration sensor for detecting vibration generated upon operation of the instrument and transmitted therefrom. FIGS. 27 and 28 schematically illustrate the construction of a tuner in which a tuner main body 700 is connected to the clip 100 via a connecting portion 702 containing a joint mechanism.

FIG. 28 illustrates how vibration generated from the instrument is propagated via the clip 100 to a vibration sensor 701 contained in the tuner main body 700.

In FIGS. 27 and 28, the tuner main body 70 is fixed to the instrument part (e.g., head portion of a guitar) 600 by means of the clip 100.

When the instrument is operated in this state, vibration 250 generated from the instrument is propagated, as illustrated in FIG. 28, in the following order: the instrument part 600 to which the tuner main body 700 is fixed by the clip 100, the clip 100, the connecting portion 702 (joint mechanism), and the vibration sensor 701 in the tuner main body 700. When there exist rubber, a hinge, a joint mechanism, etc. in the propagation route for the vibration 250, the vibration 250 generated from the instrument is attenuated at this joint mechanism portion, making it rather difficult in some cases to obtain a sufficient sensitivity for the tuner. In particular, in an instrument in which the vibration generated through playing quickly attenuates as in the case of a string instrument, the failure to obtain a sufficient sensitivity may prove fatal to the tuning performance of the product.

In order to improve the sensitivity of a clip-type tuner, it is more important to provide the tuner on the clip side so that the tuner is close to the instrument during use of the tuner, than to provide within the tuner main body a vibration sensor for detecting the vibration generated from the instrument. This is due to the fact that the larger the length of the propagation route for the vibration 250, the larger the degree to which the vibration 250 is attenuated.

When, in the clip-type tuner, it is necessary to provide a vibration sensor on the clip side, it is necessary to electrically connect the vibration sensor provided on the clip side and an electronic circuit contained in the tuner main body. However, as described above, the joint mechanism exists between the clip and the tuner main body, and the joint mechanism, which is freely movable, constitutes an obstacle to attaining electrical connection.

At present, the commercially available clip-type tuners that are provided with a vibration sensor on the clip side have a connecting portion of a very complicated structure between the clip and the tuner main body. Due to the complicated structure of the connecting portion between the clip and the tuner main body, the clip-type tuner provided with a vibration sensor on the clip side is subject to failure, resulting in many claims from the users and high cost due to its structure.

SUMMARY OF THE INVENTION

The present invention has been made in view of the above-mentioned problems in the related art. It is an object of the present invention to provide a tuner mounting device which does not scratch the instrument and which provides a satisfactory sensitivity to the vibration generated from the instrument.

In order to achieve the above-mentioned object, a tuner mounting device according to the present invention includes a tuner mounting device for mounting a tuner to be attached to an instrument, in which a tuner main body is fixed to a part of the instrument by a hook-and-loop fastener.

In the tuner mounting device of the present invention constructed as described above, the tuner main body is fixed to the part of the instrument by the hook-and-loop fastener In this way, in the present invention, the hook-and-loop fastener is used as the mounting device, which means there is used a material softer than the clip of the conventional device; thus, when fixing the tuner to the target instrument, the possibility of the instrument being scratched or the material being rubbed off on the instrument like rubber is low, and hence the user is free from care when using the device.

Further, when the tuner is fixed to the instrument by a hook-and-loop fastener as in the case of the tuner mounting device of the present invention, the mounting possible regardless of the size of the instrument through adjustment of the length of the hook-and-loop fastener, and hence it is possible to attain a high degree of freedom in terms of the size of the instrument to which the tuner mounting device is applied.

Further, since the tuner main body can be mounted to the hook-and-loop fastener, it is possible to mount the tuner main body at a position nearest to the instrument when compared with the conventional clip-type device, and, there exists no joint mechanism in between as in the conventional clip-type device. Thus, the vibration propagation distance to the vibration sensor is reduced, whereby the attenuation of the vibration generated through operation of the instrument is mitigated, and the sensitivity of the tuner is improved.

Further, in the tuner mounting device of the present invention, a vibration sensor for detecting vibration generated through operation of the instrument is contained in the tuner main body.

In the tuner mounting device of the present invention, constructed as described above, the vibration sensor is contained in the tuner main body. However, since the tuner main body can be mounted to the hook-and-loop fastener itself, it is possible to mount the tuner main body at a position nearest to the instrument when compared with the conventional clip-type device, and there exists no joint mechanism in between as in the case of the conventional clip-type device. Thus, the vibration propagation distance to the vibration sensor is reduced, and the attenuation of the vibration generated through operation of the instrument is mitigated, thereby achieving an improvement in terms of the sensitivity of the tuner.

Further, in the tuner mounting device of the present invention, the hook-and-loop fastener is provided with a vibration sensor for detecting vibration generated through operation of the instrument.

In the tuner mounting device of the present invention constructed as described above, the hook-and-loop fastener is provided with the vibration sensor.

As a result, it is possible to bring the vibration sensor into direct contact with the instrument, and hence the vibration generated through operation of the instrument can be detected more effectively, thereby achieving an improvement in terms of the sensitivity of the tuner.

Further, by providing the hook-and-loop fastener with a plurality of vibration sensors, it is possible to achieve higher tuner sensitivity.

Further, a tuner mounting device according to the present invention includes a tuner mounting device for mounting a tuner to be attached to an instrument, in which a tuner main body containing a vibration sensor for detecting vibration generated through operation of the instrument is placed on an upper surface of a part of the instrument through an intermediation of a buffer material, and in which, in this state, the tuner main body is fixed to the instrument so as to integrally surround and fasten the instrument and the tuner main body by a hook-and-loop fastener.

In the tuner mounting device of the present invention constructed as described above, the tuner main body containing the vibration sensor is placed on the upper surface of the part of the instrument through the intermediation of the buffer material, and, in this state, the tuner main body is fixed to the instrument so as to integrally surround and fasten the instrument and the tuner main body by the hook-and-loop fastener.

As a result, it is possible to prevent the instrument from being scratched due to the buffer material (e.g., silicone rubber) provided between the instrument and the tuner main body when the tuner main body is fixed to the instrument.

Although the vibration generated in the instrument is attenuated to some degree due to the presence of the buffer material, it is possible to attain a sufficient sensitivity.

Further, a tuner mounting device according to the present invention includes a tuner mounting device for mounting a tuner to be attached to an instrument, in which a first hook-and-loop fastener constituting a base is affixed to the surface of a part of the instrument on a constant basis, in which a second hook-and-loop fastener is fixedly installed on a lower surface of a tuner main body containing a vibration sensor for detecting vibration generated through operation of the instrument, and in which the tuner main body is fixed to the part of the instrument by attaching the first and second hook-and-loop fasteners to each other.

In the tuner mounting device of the present invention constructed as described above, the first hook-and-loop fastener constituting the base is placed on the surface of the part of the instrument on a constant basis, the second hook-and-loop fastener is fixedly installed on a lower surface of a tuner main body containing the vibration sensor. The tuner main body is fixed to the part of the instrument by attaching the first hook-and-loop fastener and the second hook-and-loop fastener to each other.

In this way, by providing both the instrument and the tuner main body with a hook-and-loop fastener, it is possible to attach and detach the tuner main body as needed.

Further, in a tuner mounting device of the present invention, a mounting base portion for fixing a tuner main body to a part of the instrument is fixed to the instrument on a constant basis by a hook-and-loop fastener, a structure to be fitted into the mounting base portion is provided on a lower surface of the tuner main body containing a vibration sensor for detecting vibration generated through operation of the instrument, and the tuner main body is fixed to the part of the instrument by attaching the structure to the mounting base portion.

In the tuner mounting device of the present invention constructed as described above, a mounting base portion for fixing the tuner main body to the part of the instrument is fixed to the instrument on the constant basis by the hook-and-loop fastener, the structure to be fitted into the mounting base portion is provided on the lower surface of the tuner main body containing the vibration sensor. The tuner main body is fixed to the part of the instrument by attaching the structure to the mounting base portion.

As a result, the tuner main body can be reliably fixed to the instrument; further, the tuner main body can be easily attached and detached to and from the instrument.

Further, in a tuner mounting device of the present invention, a mounting base portion for fixing a tuner main body to a part of the instrument is fixed to the instrument on a constant basis by a hook-and-loop fastener, with a structure to be fitted into the mounting base portion being provided on a lower surface of a tuner main body containing a vibration sensor for detecting vibration generated through operation of the instrument, the mounting base portion has a power source portion and a power supply contact, with the structure having an electrical contact corresponding to a power supply contact provided on the mounting base portion, and the tuner main body is fixed to the part of the instrument by attaching the structure to the mounting base portion, with power being supplied to an electronic circuit inside the tuner main body from the power source portion contained in the mounting base portion via the power supply contact and the electrical contact provided on the structure.

In the tuner mounting device of the present invention constructed as described above, the mounting base portion for fixing the tuner main body to the part of the instrument is fixed to the instrument on the constant basis by the hook-and-loop fastener, with the structure to be fitted into the mounting base portion being provided on the lower surface of the tuner main body containing the vibration sensor for detecting vibration generated through operation of the instrument.

The mounting base portion has the power source portion and the power supply contact, with the structure having an electrical contact corresponding to the power supply contact provided on the mounting base portion. The tuner main body is fixed to the part of the instrument by attaching the structure to the mounting base portion, with power being supplied to the electronic circuit inside the tuner main body from the power source portion contained in the mounting base portion via the power supply contact and the electrical contact provided on the structure.

In this way, the power source portion (e.g., battery) necessary for the tuner main body is provided on the side of the mounting base portion fixed to the instrument main body, and hence it is possible to reduce the size of the tuner main body.

Further, in a tuner mounting device of the present invention, a mounting base portion for fixing a tuner main body to a part of the instrument is fixed to the instrument on a constant basis by a hook-and-loop fastener, with a structure to be fitted into the mounting base portion being provided on a lower surface of the tuner main body, the mounting base portion has a vibration sensor for detecting vibration generated through operation of the instrument and a vibration sensor signal contact, with the structure having an electrical contact corresponding to the vibration sensor signal contact provided on the mounting base portion, and the tuner main body is fixed to a part of the instrument by attaching the structure to the mounting base portion, with the vibration sensor contained in the mounting base portion being connected to an electronic circuit inside the tuner main body via the vibration sensor signal contact and an electrical contact provided on the structure.

In the tuner mounting device of the present invention constructed as described above, the mounting base portion for fixing the tuner main body to the part of the instrument is fixed to the instrument on the constant basis by the hook-and-loop fastener, with the structure to be fitted into the mounting base portion being provided on the lower surface of the tuner main body.

The mounting base portion has the vibration sensor and the vibration sensor signal contact, with the structure having the electrical contact corresponding to the vibration sensor signal contact provided on the mounting base portion.

The tuner main body is fixed to the part of the instrument by attaching the structure to the mounting base portion, with the vibration sensor contained in the mounting base portion being connected to the electronic circuit inside the tuner main body via the vibration sensor signal contact and the electrical contact provided on the structure.

In this way, when the vibration sensor is provided on the side of the mounting base portion fixed to the instrument main body, and the tuner main body is fixed to the instrument, the vibration sensor is electrically connected to the electronic circuit in the tuner main body, and hence it is possible to achieve a reduction in the size of the tuner main body.

Further, in a tuner mounting device of the present invention, a mounting base portion for fixing a tuner main body to a part of the instrument is fixed to the instrument on a constant basis by a hook-and-loop fastener, with a structure to be fitted into the mounting base portion being provided on a lower surface of the tuner main body, the mounting base portion has an power source portion, a vibration sensor for detecting vibration generated through operation of the instrument, a power supply contact, and a vibration sensor signal contact, with the structure having a first electrical contact corresponding to the power supply contact and a second electrical contact corresponding to the vibration sensor signal contact, and the tuner main body is fixed to the part of the instrument by attaching the structure to the mounting base portion, and power is supplied to an electronic circuit inside the tuner main body from the power source portion contained in the mounting base portion via the first electrical contact provided on the structure, with the vibration sensor being connected to the electronic circuit inside the tuner main body via the vibration sensor signal contact and the second electrical contact.

In the tuner mounting device of the present invention constructed as described above, the mounting base portion for fixing the tuner main body to the part of the instrument is fixed to the instrument on a constant basis by the hook-and-loop fastener, with the structure to be fitted into the mounting base portion being provided on the lower surface of the tuner main body.

Further, the mounting base portion has the power source portion, the vibration sensor, the power supply contact, and the vibration sensor signal contact, with the structure having the first electrical contact corresponding to the power supply contact and the second electrical contact corresponding to the vibration sensor signal contact, and the tuner main body is fixed to the part of the instrument by attaching the structure to the mounting base portion, and power is supplied to the electronic circuit inside the tuner main body from the power source portion contained in the mounting base portion via the first electrical contact provided on the structure, with the vibration sensor being connected to the electronic circuit inside the tuner main body via the vibration sensor signal contact and the second electrical contact.

In this way, when the power source portion (e.g., battery) necessary for the tuner main body and the vibration sensor are provided on the side of the mounting base portion fixed to the instrument main body, the tuner main body is fixed to the instrument, the vibration sensor is electrically connected to the electronic circuit within the tuner main body, and power is supplied to the electronic circuit from the power source portion. Thus, it is possible to achieve a further reduction in the size of the tuner main body.

Further, in the tuner mounting device of the present invention, a mounting base portion for fixing a tuner main body to a part of the instrument is fixed to the instrument on a constant basis by a hook-and-loop fastener through the intermediation of a material having stretchability, with a structure to be fitted into the mounting base portion being provided on a lower surface of the tuner main body. Further, the tuner main body is fixed to a part of the instrument by attaching the structure to the mounting base portion.

In the tuner mounting device of the present invention constructed as described above, the mounting base portion for fixing a tuner main body to the part of the instrument is fixed to the instrument on a constant basis by the hook-and-loop fastener through the intermediation of a material having stretchability, with the structure to be fitted into the mounting base portion being provided on the lower surface of the tuner main body. Further, the tuner main body is fixed to the part of the instrument by attaching the structure to the mounting base portion. If the above mounting base portion is not used, it is possible to mount the tuner main body to the part of the instrument by the hook-and-loop fastener alone, utilizing a material having stretchability.

In this way, by constantly fixing the mounting base portion to the instrument by the hook-and-loop fastener through the intermediation of an expandable material, and attaching to the mounting base portion the structure provided on the lower surface of the tuner main body, it is possible to firmly hold the tuner main body and the instrument in intimate contact with each other and to prevent their detachment.

Further, in the tuner mounting device of the present invention, functional portions of the tuner are formed as a plurality of assemblies, and the plurality of assemblies are connected together while being electrically connected to each other by a conductive hook-and-loop fastener, and are fixed to the instrument in the connected state by the hook-and-loop fastener.

In the tuner mounting device of the present invention constructed as described above, the functional portions of the tuner are formed as the plurality of assemblies, and wherein the plurality of assemblies are connected together while being electrically connected to each other by the conductive hook-and-loop fastener, and are fixed to the instrument in the connected state by the hook-and-loop fastener.

In this way, the functional portions of the tuner are formed as a plurality of assemblies, and the plurality of assemblies are connected together while being electrically connected by the conductive hook-and-loop fastener, and hence it is possible to individually replace the functional portions of the tuner, making it possible to easily build a system meeting the needs of the user.

Further, in the tuner mounting device of the present invention, the tuner has on the outside a display means having a radio communication function, with functional portions constituting the tuner except for the display means being formed as a plurality of independent assemblies.

Further, the plurality of assemblies include a communication means having a radio communication function, with the plurality of assemblies being fixed to the instrument by a conductive hook-and-loop fastener while being electrically connected to each other by the conductive hook-and-loop fastener, and the communication means transmits data indicating the instrument tuning state to the display means on the outside through radio communication.

In the tuner mounting device of the present invention constructed as described above, the tuner has on the outside a display means having a radio communication function, with the functional portions constituting the tuner except for the display means being formed as a plurality of independent assemblies.

Further, the plurality of assemblies include a communication means having a radio communication function, with the plurality of assemblies being fixed to the instrument by a conductive hook-and-loop fastener while being electrically connected to each other by the conductive hook-and-loop fastener, and the communication means transmits data indicating the instrument tuning state to the display means on the outside through radio communication. As a result, the display device receives data indicating the instrument tuning state from the communication unit, and displays the instrument tuning state.

As a result, it is possible to display the instrument tuning state through the display device installed externally and having a radio communication function.

As described above, according to the present invention, the hook-and-loop fastener is used as the mounting device, which means there is used a material softer than the clip of the conventional device, and hence, when fixing the tuner to the target instrument, the possibility of the instrument being scratched or the material being rubbed off on the instrument as in the case of rubber is low. As a result, the user is free from care when using the mounting device.

In the case in which the tuner is fixed to the instrument by the hook-and-loop fastener as in the case of the tuner mounting device of the present invention, the mounting is possible regardless of the size of the instrument through adjustment of the length of the hook-and-loop fastener, and hence it is advantageously possible to achieve a high degree of freedom in terms of the size of the target instrument.

Further, since the tuner main body can be mounted to the hook-and-loop fastener itself, it is possible to mount the tuner main body at a position nearest to the instrument as compared with the clip-type conventional device. In addition, since no joint mechanism exists in between as in the conventional device, the vibration propagation distance to the vibration sensor is reduced. As a result, the attenuation of the vibration generated through operation of the instrument is mitigated, and it is possible to achieve an improvement in terms of the sensitivity of the tuner.

DETAILED DESCRIPTION OF THE PREFERRED EMBODIMENTS

In the following, embodiments of the present invention are described with reference to the drawings. Tuner mounting devices according to embodiments of the present invention basically use a hook-and-loop fastener instead of the conventional clip-type clip of the tuner mounting device.

Figure 1A:
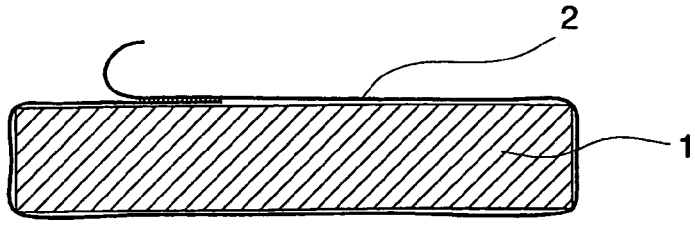
FIGS. 1A and 1B are explanatory views illustrating how a hook-and-loop fastener is wrapped around and fastened to a part of an instrument.
Figure 1B:
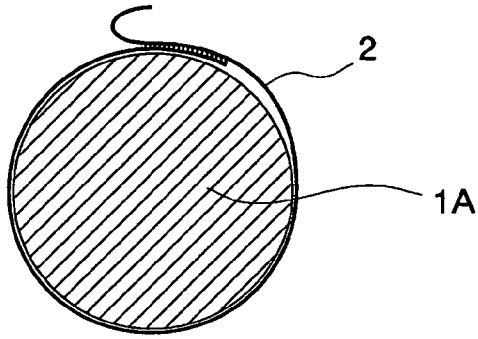

FIGS. 1A and 1B illustrate how a hook-and-loop fastener is fixed to a part of an instrument through wrapping and fastening; FIG. 1A illustrates how a hook-and-loop fastener 2 is fixed, for example, to a head portion 1 of a guitar through wrapping and fastening, and FIG. 1B illustrates how the hook-and-loop fastener 2 is fixed, for example, to a fat tubular portion 1A of a bass instrument through wrapping and fastening.

First Embodiment

Figure 2A:
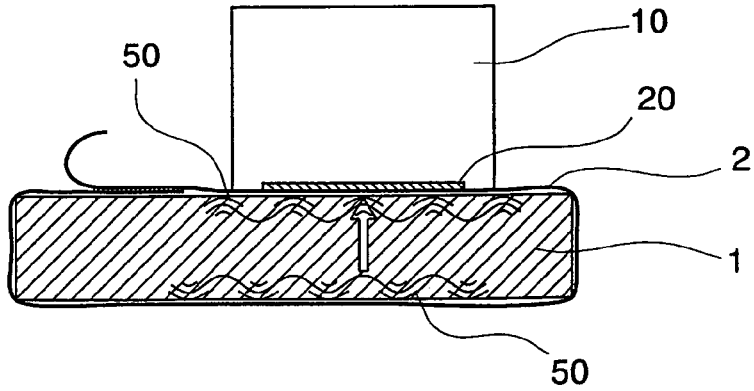
FIGS. 2A and 2B are diagrams illustrating construction of a tuner mounting device according to a first embodiment of the present invention.
Figure 2B:
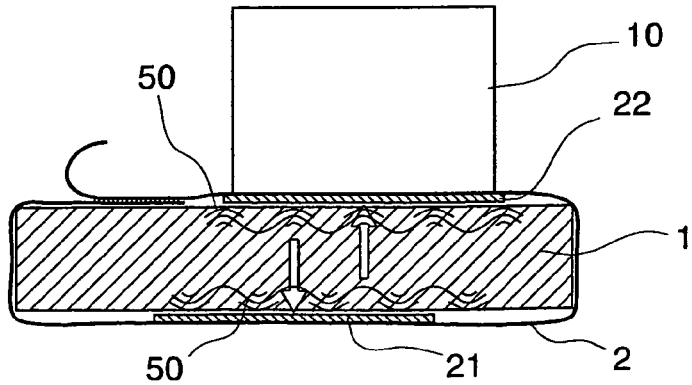

FIGS. 2A and 2B illustrate the construction of a tuner mounting device according to a first embodiment of the present invention. In this embodiment, the tuner main body is fixed to a part of an instrument (e.g., the head portion of a guitar) by a hook-and-loop fastener. FIG. 2A illustrates how a tuner main body 10 is fixed to a head portion 1 of a guitar by a hook-and-loop fastener 2. In this example, the hook-and-loop fastener is affixed, for example, to the bottom portion of the tuner main body 10, and the tuner main body 10 is placed on the guitar head portion around which a hook-and-loop fastener of a different kind is wrapped and fastened, whereby it is possible to fix the tuner main body 10 to the guitar head portion 1.

Further, it is also possible to mount a member for belt insertion to the tuner main body 10, and to pass the hook-and-loop fastener 2 wrapped and fastened around the guitar head portion 1 through the same, thereby fixing the tuner main body 10 to the guitar head portion 1 by wrapping and fastening the hook-and-loop fastener 2 so as to press the tuner main body to the guitar head portion 1.

Here, the kind of hook-and-loop fastener used is one consisting of one surface which is raised in hook-like manner and another surface which is raised in loop-like manner arranged closely together. As is well known, they are attached together by being pressed against each other, and allow separation.

In the example illustrated in FIG. 2A, a vibration sensor 20 for detecting vibration 50 generated through operation of the instrument is contained in the tuner main body 10.

In the example of FIG. 2A, a hook-and-loop fastener is used as a mounting device, and hence the material used is softer than the clip of the conventional device; thus, the possibility of the target instrument being scratched or the material being allowed to rubbed off on the instrument at the time of fixation of the tuner is low, making the user free of care when using the device.

Further, the tuner main body is fixed and mounted to an instrument by means of a hook-and-loop fastener, and hence the mounting is possible to regardless of the size of the instrument through adjustment of the length of the hook-and-loop fastener, which advantageously leads to a high degree of freedom in terms of the size of the target instrument.

Further, since the tuner main body can be mounted to the hook-and-loop fastener itself, it is possible to mount the tuner main body at a position nearest the instrument, and no joint mechanism exits in between as compared with the conventional clip-type device, and hence the propagation distance to the vibration sensor is reduced, and the vibration attenuation due to operation of the instrument is mitigated, making it possible to achieve an improvement in terms of the sensitivity of the tuner.

While in the example of the tuner mounting device illustrated in FIG. 2A the vibration sensor is contained in the tuner main body, because the tuner main body can be mounted to the hook-and-loop fastener itself, it is possible to mount the tuner main body at a position nearest to the instrument as compared with the clip-type conventional device, and no joint mechanism exists in between as in the clip-type conventional device, and hence the vibration propagation distance to the vibration sensor is reduced, and the attenuation of the vibration generated through operation of the instrument is mitigated, thereby improving the sensitivity of the tuner.

In the example illustrated in FIG. 2B, a vibration sensor is provided on the hook-and-loop fastener 2 of the tuner mounting device, which fixes the tuner main body to a part of an instrument by means of the hook-and-loop fastener. As illustrated in the drawing, the tuner main body 10 is fixed, for example, to the guitar head portion 1 by means of a hook-and-loop fastener 2 having vibration sensors 21 and 22. In this example, the hook-and-loop fastener 2 is affixed, for instance, to the bottom portion of the tuner main body 10, and the tuner main body 10 is placed on the guitar head portion 1 around which the hook-and-loop fastener which is different from that affixed to the bottom portion is wrapped and fastened, whereby it is possible to fix the tuner main body 10 to the guitar head portion 1.

As a result, it is possible to hold the vibration sensor in direct contact with the instrument, and hence the vibration generated through operation of the instrument can be detected effectively, thereby achieving an improvement in terms of the sensitivity of the tuner.

Further, by providing the hook-and-loop fastener 2 with a plurality of vibration sensors 21 and 22, it is possible to enhance the sensitivity of the tuner. The number of vibration sensors installed is not restricted to two, and it may also be three or more.

Second Embodiment

Figure 3:
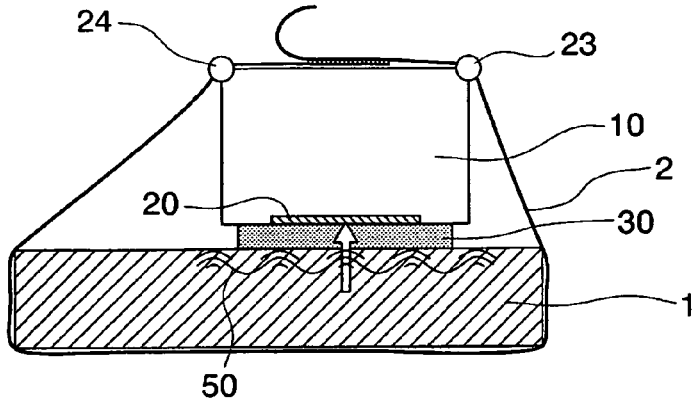
FIG. 3 is a diagram illustrating construction of a tuner mounting device according to a second embodiment of the present invention.

Next, FIG. 3 illustrates the construction of the tuner mounting device of the second embodiment of the present invention. As illustrated in the drawing, in the tuner mounting device of the second embodiment of the present invention, the tuner main body 10 containing the vibration sensor 20 for detecting vibration generated through operation of the instrument is placed on the upper surface of the instrument part 1 through the intermediation of a buffer material 30, and, in this state, the instrument part 1 and the tuner main body 10 are integrally surrounded and fastened by the hook-and-loop fastener 2 via belt loops 23 and 24, thereby fixing the tuner main body 10 to the instrument.

As the buffer material, there is used, for example, silicone rubber, which should not be construed restrictively, and it is possible to use various other materials.

In the tuner mounting device of the second embodiment of the present invention, the tuner main body containing the vibration sensor is placed on the upper surface of a part of the instrument through the intermediation of a buffer material, and, in this state, the instrument and the tuner main body are integrally surrounded and fastened by the hook-and-loop fastener, and hence it is possible to prevent the instrument from being scratched when fixing the tuner main body to the instrument due to the presence of the buffer material provided between the instrument and the tuner main body.

When the vibration generated in the instrument is attenuated to some degree when detected by the vibration sensor due to the presence of the buffer material. However, it is possible to attain a sufficient sensitivity for the tuner.

Third Embodiment

Figure 4:
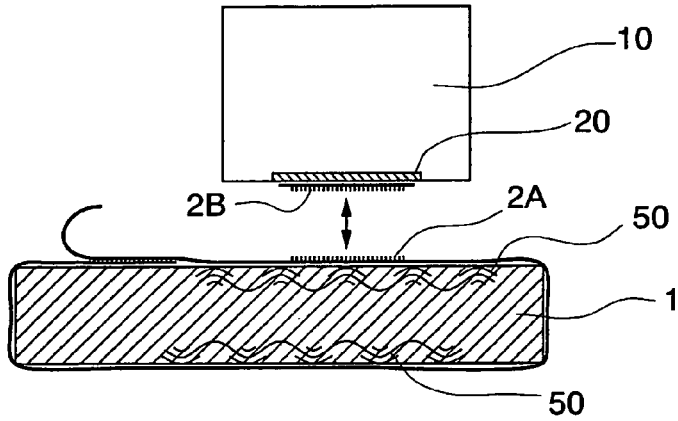
FIG. 4 is a diagram illustrating construction of a tuner mounting device according to a third embodiment of the present invention.

Next, FIG. 4 illustrates the construction of the tuner mounting device of the third embodiment of the present invention.

In the tuner mounting device of the third embodiment of the present invention, a first hook-and-loop fastener 2A serving as a base is installed on a constant basis on the surface of the instrument part 1, and a second hook-and-loop fastener 2B is fixedly provided on the lower surface of the tuner main body 10 containing the vibration sensor 20.

By attaching the first hook-and-loop fastener 2A and the second hook-and-loop fastener 2B to each other, the tuner main body 10 is fixed to the instrument part 1.

In this way, in the tuner mounting device of the third embodiment of the present invention, both the instrument and the tuner main body are equipped with a hook-and-loop fastener, whereby it is possible to attach and detach the tuner main body as needed.

Figure 5:
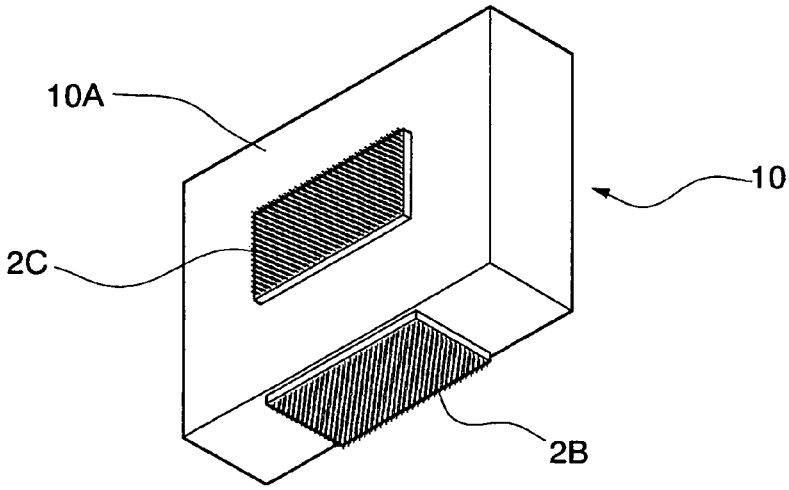
FIG. 5 is a diagram illustrating a rear surface structure of a tuner main body in the tuner mounting device according to the third embodiment of the present invention illustrated in FIG. 4.
Figure 6:
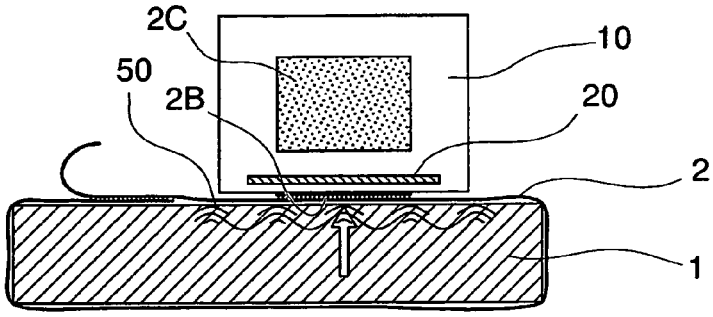
FIG. 6 is a diagram illustrating a state during tuning of the tuner mounting device according to the third embodiment of the present invention.

Further, as illustrated in FIG. 5, it is also possible to affix a third hook-and-loop fastener 2C for accommodation to the back surface 10A of the tuner main body 10 on a constant basis. That is, as illustrated in FIG. 6, at the time of tuning, the tuner main body 10 is fixed to the instrument part 1 by attaching to each other the first hook-and-loop fastener 2A provided on the instrument side and the second hook-and-loop fastener 2B provided on the tuner side.

Figure 7:
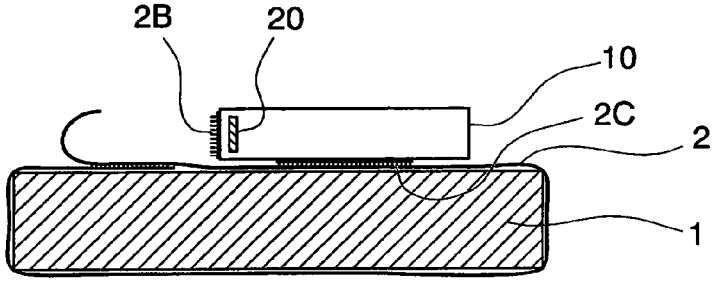
FIG. 7 is a diagram illustrating an accommodated state of the tuner mounting device according to the third embodiment of the present invention.

Further, as illustrated in FIG. 7, when accommodating the tuner main body 10 on the instrument part 1, the first hook-and-loop fastener 2A provided on the instrument side and the third hook-and-loop fastener 2C affixed to the back surface 10A of the tuner main body 10 may be attached to each other, thereby accommodating the tuner main body 10 on the instrument part 1.

In this way, the surface of the tuner main body mounted to the instrument when not in use is made different from the surface thereof when tuning is to be performed, whereby the tuner main body can be accommodated on the instrument in a compact fashion.

Figure 8:
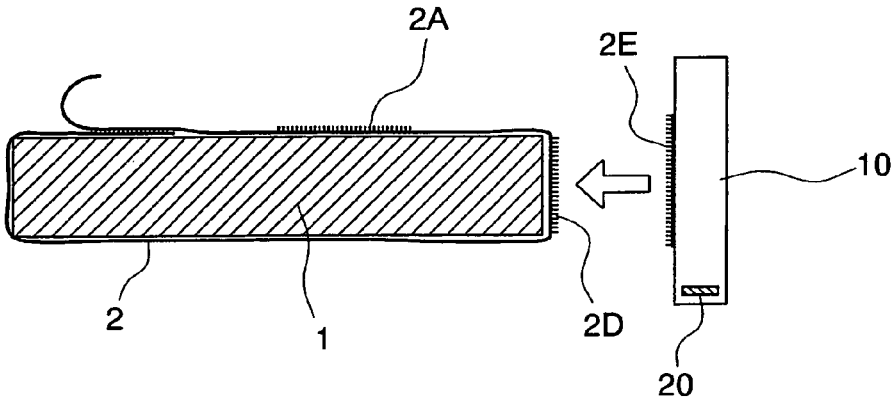
FIG. 8 is a diagram illustrating a modification of the tuner mounting device according to the third embodiment of the present invention.

Further, as illustrated in FIG. 8, in addition to the first hook-and-loop fastener 2A of the instrument part 1, a fourth hook-and-loop fastener 2D is provided on a constant basis on a surface different from that on which the first hook-and-loop fastener 2A is provided, and the third hook-and-loop fastener 2C affixed to the back surface 10A of the tuner main body 10 is attached to the fourth hook-and-loop fastener 2D provided on the instrument side, whereby the tuner main body 10 is accommodated on the instrument part 1.

Fourth Embodiment

Figure 9:
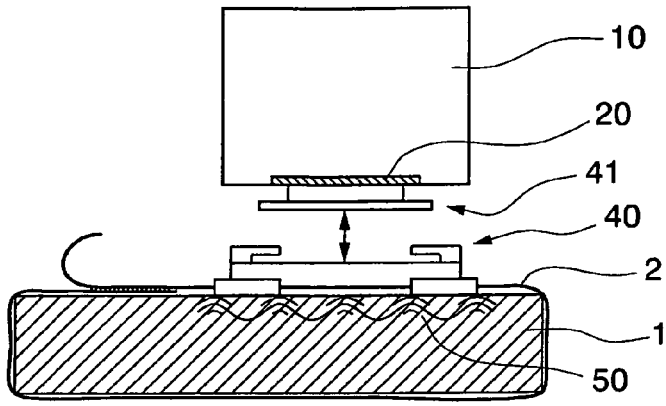
FIG. 9 is a diagram illustrating construction of a tuner amounting device according to a fourth embodiment of the present invention.

Next, FIG. 9 illustrates the construction of the tuner mounting device according to the fourth embodiment of the present invention. As illustrated in the drawing, in the tuner mounting device of the fourth embodiment of the present invention, a mounting base portion 40 for fixing the tuner main body 10 containing the vibration sensor 20 to the instrument part 1 is fixed to the instrument on a constant basis by means of the hook-and-loop fastener 2. Further, a structure 41 to be fitted into the mounting base portion 40 is provided on the lower surface of the tuner main body 10.

By attaching the structure 41 provided on the lower surface of the tuner main body 10 to the mounting base portion 40, the tuner main body 10 is fixed to the instrument part 1.

In this way, in the tuner mounting device of the fourth embodiment of the present invention, the mounting base portion is fixed to a part of the instrument by means of a hook-and-loop fastener, and the mounting base portion and the structure provided on the lower surface of the tuner main body 10 are detachable with respect to each other, and hence the tuner main body can be reliably fixed to the instrument and, further, the tuner main body can be easily attached and detached to and from the instrument.

Figure 10:
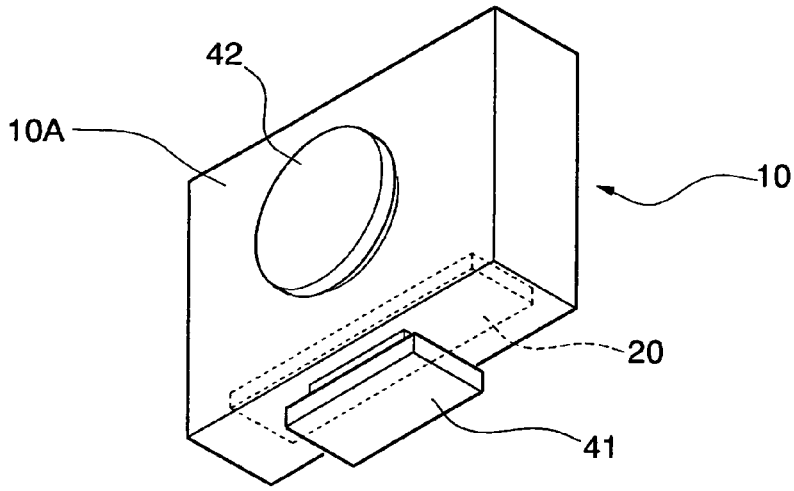
FIG. 10 is a diagram illustrating a rear surface structure of a tuner main body in the tuner mounting device according to the fourth embodiment of the present invention illustrated in FIG. 9.
Figure 11:
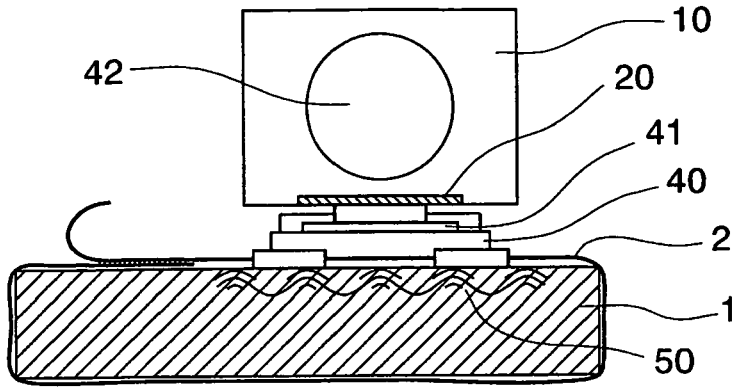
FIG. 11 is a diagram illustrating a state during tuning of the tuner mounting device according to the fourth embodiment of the present invention.

Further, as illustrated in FIG. 10, it is also possible to provide on the back surface 10A of the tuner main body 10 an accommodation structure 42 to be fitted into the mounting base portion 40. That is, as illustrated in FIG. 11, at the time of tuning, the structure 41 provided on the lower surface of the tuner main body 10 is attached to the mounting base portion 40, thereby fixing the tuner main body 10 to the instrument part 1.

Figure 12:
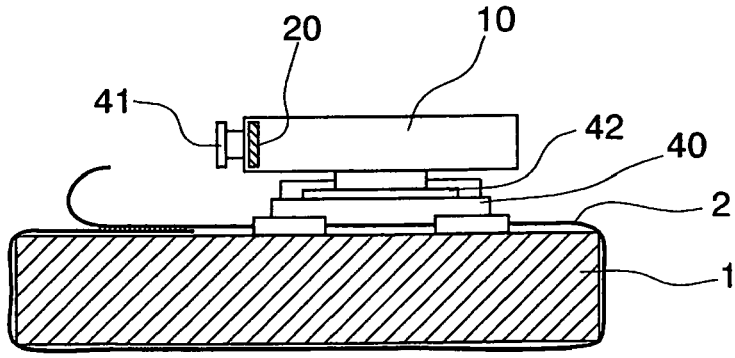
FIG. 12 is a diagram illustrating an accommodated state of the tuner mounting device according to the fourth embodiment of the present invention.

Further, as illustrated in FIG. 12, when accommodating the tuner main body 10 on the instrument part 1, the structure 42 provided on the back surface 10A of the tuner main body 10 is attached to the mounting base portion 40 provided on the instrument side, thereby accommodating the tuner main body 10 on the instrument part 1.

In this way, the surface of the tuner main body to be mounted to the instrument when not in use is made different from the surface thereof mounted to the instrument at the time of tuning, whereby it is possible to accommodate the tuner main body on the instrument in a compact fashion.

Fifth Embodiment

Figure 13:
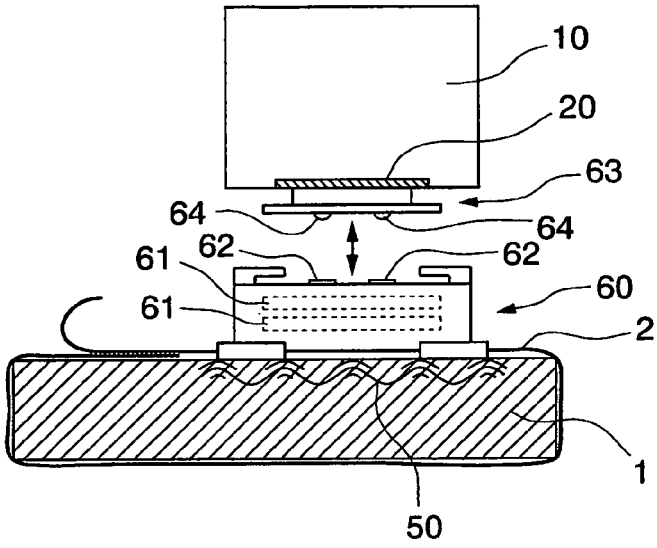
FIG. 13 is a diagram illustrating construction of a tuner amounting device according to a fifth embodiment of the present invention.

Next, FIG. 13 illustrates the construction of the tuner mounting device of the fifth embodiment of the present invention. As illustrated in the drawing, in the tuner mounting device of the fifth embodiment of the present invention, a mounting base portion 60 for fixing the tuner main body 10 to the instrument part 1 is fixed on a constant basis to the instrument part 1 by means of the hook-and-loop fastener 1, and a structure 63 to be fitted into the mounting base portion 60 is provided on the lower surface of the tuner main body 10 containing the vibration sensor 20 for detecting the vibration generated through operation of the instrument.

The mounting base portion 60 has a power source portion 61 and power supply contacts 62.

Further, the structure 63 has electrical contacts 64 in correspondence with the power supply contacts 62 provided on the mounting base portion 60.

By attaching the structure 63 to the mounting base portion 60, the tuner main body 10 is fixed to the instrument part 1, and power is supplied from the power source portion 61 contained in the mounting base portion 60 to the electronic circuit in the tuner main body 10 via the power supply contacts 62 and the electrical contacts 64 provided on the structure 63.

In the tuner mounting device of the present invention constructed as described above, the requisite power source portion (e.g., battery) for the tuner main body is provided on the side of the mounting base portion fixed to the instrument, and hence it is possible to achieve a reduction in the size of the tuner main body.

Sixth Embodiment

Figure 14:
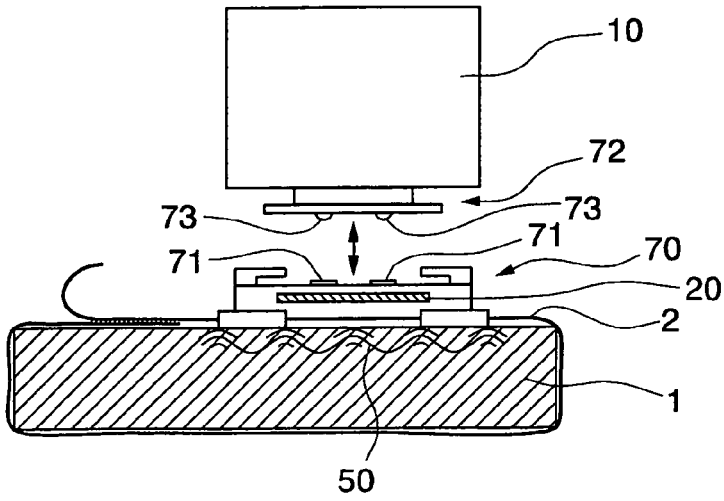
FIG. 14 is a diagram illustrating construction of a tuner amounting device according to a sixth embodiment of the present invention.

Next, FIG. 14 illustrates the construction of the tuner mounting device of the sixth embodiment of the present invention.

As illustrated in the drawing, in the tuner mounting device of the sixth embodiment of the present invention, a mounting base portion 70 for fixing the tuner main body 10 to the instrument part 1 is fixed on a constant basis to the instrument by means of the hook-and-loop fastener 2, and a structure 72 to be fitted into the mounting base portion 70 is provided on the lower surface of the tuner main body 10.

The mounting base portion 70 has the vibration sensor 20 for detecting the vibration generated through operation of the instrument and vibration sensor signal contacts 71.

Further, the structure 72 has electrical contacts 73 in correspondence with the vibration sensor signal contacts 71 provided on the mounting base portion 70.

By attaching the structure 72 provided on the lower surface of the tuner main body 10 to the mounting base portion 70, the tuner main body 10 is fixed to the instrument part 1, and the vibration sensor 20 contained in the mounting base portion 70 is connected to an electronic circuit in the tuner main body 10 via the vibration sensor signal contacts 71 and the electrical contacts 73 provided on the structure 72.

In this way, the vibration sensor is provided on the side of the mounting base portion fixed to the instrument main body, and when the tuner main body is fixed to the instrument, the vibration sensor is electrically connected to the electronic circuit in the tuner main body, and hence it is possible to achieve a reduction in the size of the tuner main body.

Seventh Embodiment

Figure 15:
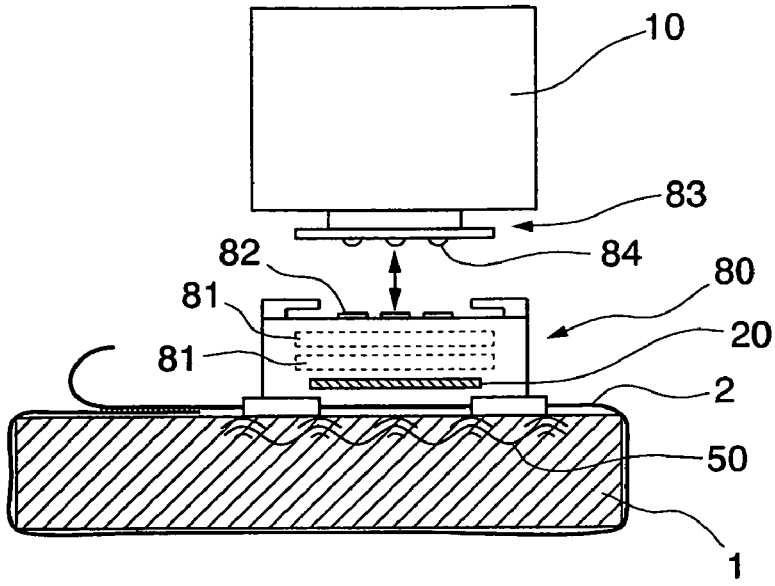
FIG. 15 is a diagram illustrating construction of a tuner amounting device according to a seventh embodiment of the present invention.

Next, FIG. 15 illustrates the construction of the tuner mounting device of the seventh embodiment of the present invention. As illustrated in the drawing, in the tuner mounting device of the seventh embodiment of the present invention, a mounting base portion 80 for fixing the tuner main body 10 to the instrument part 1 is fixed on a constant basis to the instrument by means of the hook-and-loop fastener 2, and a structure 83 to be fitted into the mounting base portion 80 is provided on the lower surface of the tuner main body 10.

Further, the mounting base portion 80 has a power source portion 81, the vibration sensor 20 for detecting the vibration generated through operation of the instrument, power supply contacts, and vibration sensor signal contacts 82.

Further, the structure 83 has first electrical contacts corresponding to the power supply contacts and second electrical contacts 84 corresponding to the vibration sensor signal contacts.

By attaching the structure 83 to the mounting base portion 80, the tuner main body 10 is fixed to the instrument part 1, and power is supplied from the power source portion 81 contained in the mounting base portion 80 to the electronic circuit in the tuner main body 10 via the power supply contacts 82 and the first electrical contacts 84 provided on the structure 83, and the vibration sensor 20 is connected to the electronic circuit in the tuner main body 10 via the vibration sensor signal contacts 82 and the second electrical contacts 84.

In this way, the power source portion (e.g., battery) necessary for the tuner main body and the vibration sensor are provided on the side of the mounting base portion fixed to the instrument main body. When the tuner main body is fixed to the instrument, the vibration sensor is electrically connected to the electronic circuit within the tuner main body, and power is supplied to the electronic circuit from the power source portion, and hence it is possible to achieve a further reduction in the size of the tuner main body.

Figure 16:
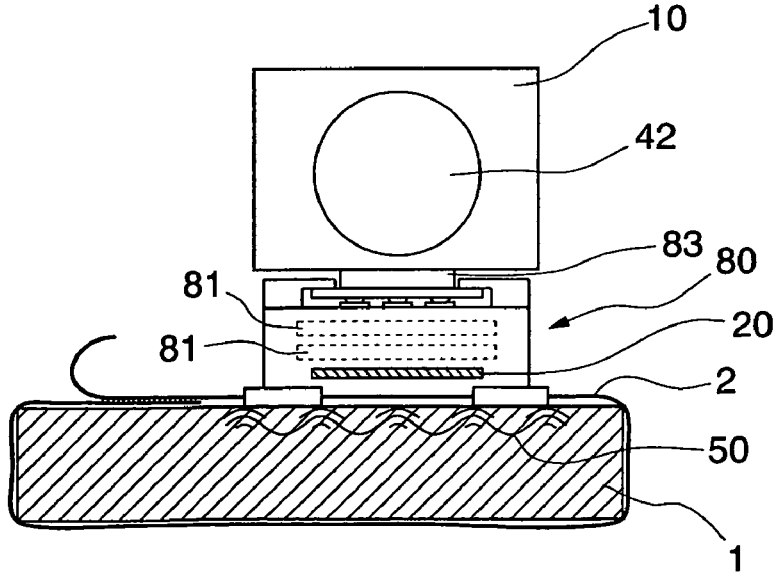
FIG. 16 is a diagram illustrating a state during tuning of the tuner mounting device according to the seventh embodiment of the present invention.

As in the fourth embodiment illustrated in FIG. 10, also in the seventh embodiment of the present invention, there may be provided on the back surface of the tuner main body 10 the accommodation structure 42 to be fitted into the mounting base portion 80. That is, as illustrated in FIG. 16, at the time of tuning, the structure 83 provided on the lower surface of the tuner main body 10 is attached to the mounting base portion 80, whereby the tuner main body 10 is fixed to the instrument part 1.

Figure 17:
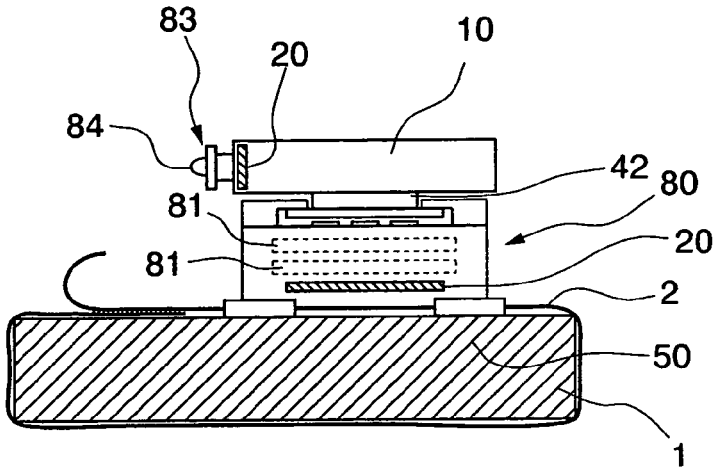
FIG. 17 is a diagram illustrating an accommodated state of the tuner mounting device according to the seventh embodiment of the present invention.

Further, as illustrated in FIG. 17, when accommodating the tuner main body 10 on the instrument part 1, the structure 42 provided on the back surface 10A of the tuner main body 10 is attached to the mounting base portion 80 provided on the instrument side, thereby accommodating the tuner main body 10 on the instrument part 1.

In this way, the surface of the tuner main body to be mounted to the instrument when not in use is made different from the surface thereof mounted to the instrument at the time of tuning, whereby it is possible to accommodate the tuner main body on the instrument in a compact fashion.

Figure 18:
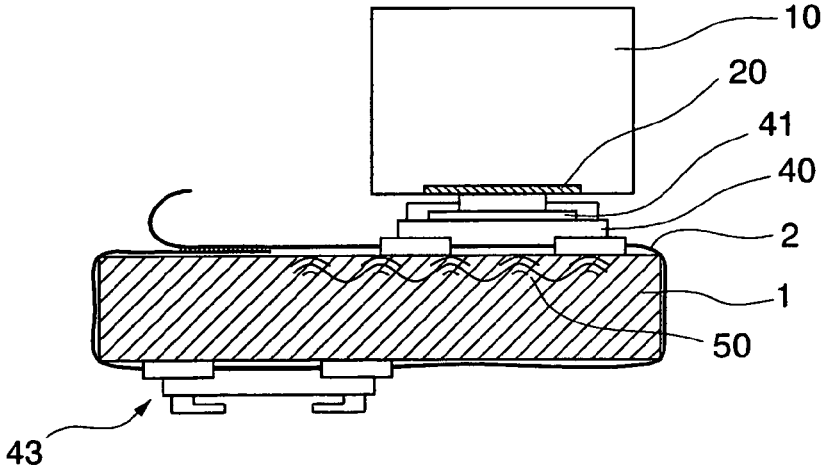
FIG. 18 is a diagram illustrating the state during tuning of a modification of the tuner mounting device according to the fourth embodiment of the present invention.

A modification of the fourth embodiment of the present invention is described with reference to FIGS. 18 and 19. As illustrated in FIG. 18, in this modification, in addition to the construction of the tuner mounting device of the fourth embodiment illustrated in FIG. 9, an accommodation mounting base 43 is further fixed to the instrument part 1 by means of the hook-and-loop fastener 2 on a constant basis, together with the mounting base portion 40, on the surface of the instrument part 1 on the side opposite to the surface where the mounting base portion 40 is provided.

As illustrated in FIG. 18, in the above-mentioned construction, at the time of turning, the structure 41 provided on the lower surface of the tuner main body 10 is attached to the mounting base portion 40, whereby the tuner main body 10 is fixed to the instrument part 1.

Figure 19:
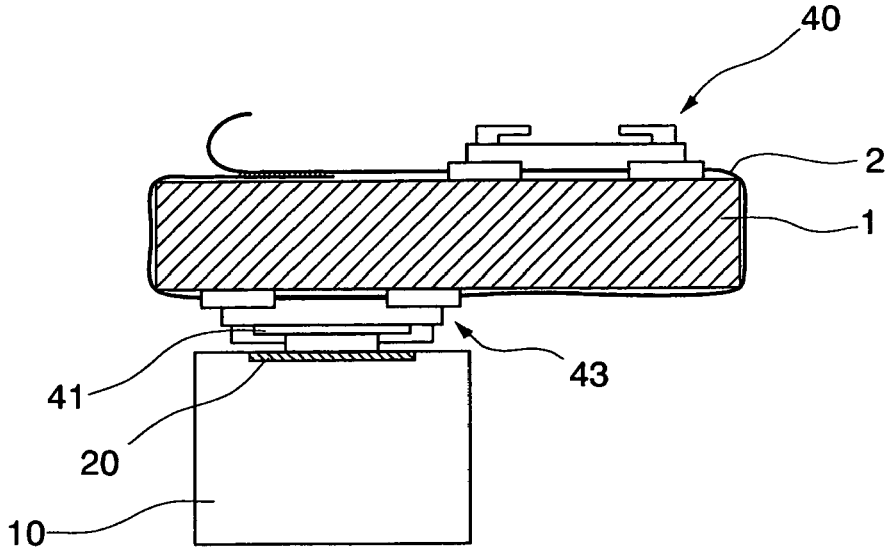
FIG. 19 is a diagram illustrating the accommodated state of the modification of the tuner mounting device according to the fourth embodiment of the present invention.

Further, as illustrated in FIG. 19, when accommodating the tuner main body 10 on the instrument part 1, the structure 41 provided on the lower surface of the tuner main body 10 is attached to the accommodation mounting base 43, whereby the tuner main body 10 is fixed to the instrument part 1.

In this way, in this modification, the surface of the instrument to which the tuner main body is fixed when not in use can be made different from that to which the tuner main body is fixed at the time of tuning.

Eighth Embodiment

Figure 20:
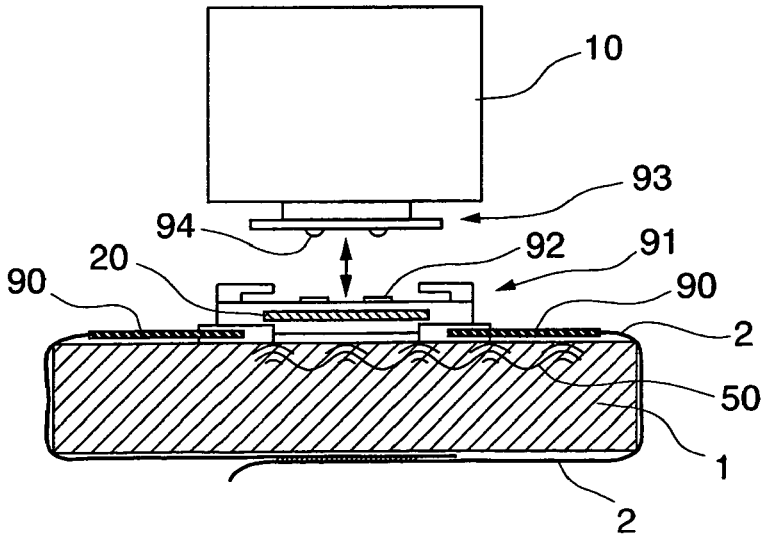
FIG. 20 is a diagram illustrating construction of a tuner mounting device according to an eighth embodiment of the present invention.

Next, FIG. 20 illustrates construction of a tuner mounting device of an eighth embodiment of the present invention. As illustrated in FIG. 20, in the tuner mounting device of the eighth embodiment of the present invention, a mounting base portion 91 for fixing the tuner main body 10 to the instrument part 1 is fixed on a constant basis to the instrument by means of the hook-and-loop fastener 2 through the intermediation of a material 90 having stretchability. The mounting base portion 91 is provided with the vibration sensor 20 for detecting the vibration generated through operation of the instrument.

Further, a structure 93 to be fitted into the mounting base portion 91 is provided on the lower surface of the tuner main body 10.

By attaching the structure 93 to the mounting base portion 91, the tuner main body 10 is fixed to the instrument part 1.

In this way, by constantly fixing the mounting base portion 91 to the instrument by the hook-and-loop fastener 2 through the intermediation of the material 90 having stretchability, and attaching to the mounting base portion 91 the structure 93 provided on the lower surface of the tuner main body 10, it is possible to firmly hold the tuner main body 10 and the instrument in intimate contact with each other.

Ninth Embodiment

Figure 21:
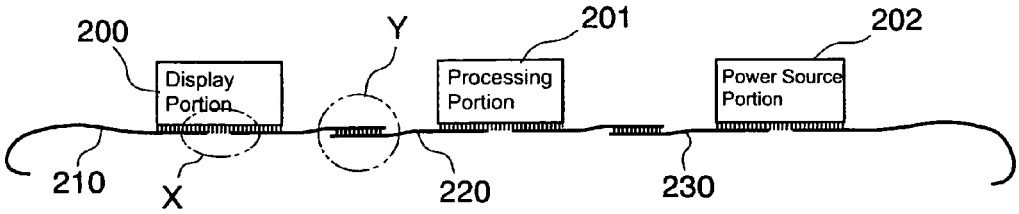
FIG. 21 is a diagram illustrating construction of a tuner mounting device according to a ninth embodiment of the present invention.

Next, FIG. 21 illustrates construction of a tuner mounting device of a ninth embodiment of the present invention.

As illustrated in FIG. 21, in the tuner mounting device of the ninth embodiment of the present invention, the functional portions of the tuner, such as a display portion 200, a processing portion 201, and a power source portion 202, are formed as a plurality of independent assemblies.

The plurality of assemblies 200, 201, and 202 are connected to each other while being electrically connected by means of conductive hook-and-loop fasteners 210, 220, and 230, and in the connected state, the assemblies 200, 201, and 202 are fixed to an instrument (not shown) by those hook-and-loop fasteners.

Figure 23A:
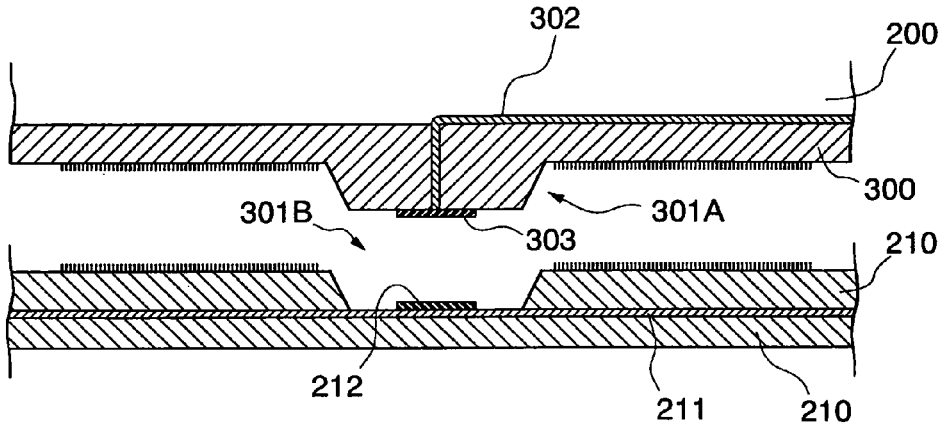
FIGS. 23A and 23B are a sectional view and a plan view illustrating an example of construction of a connecting portion between an assembly and a hook-and-loop fastener.
Figure 23B:
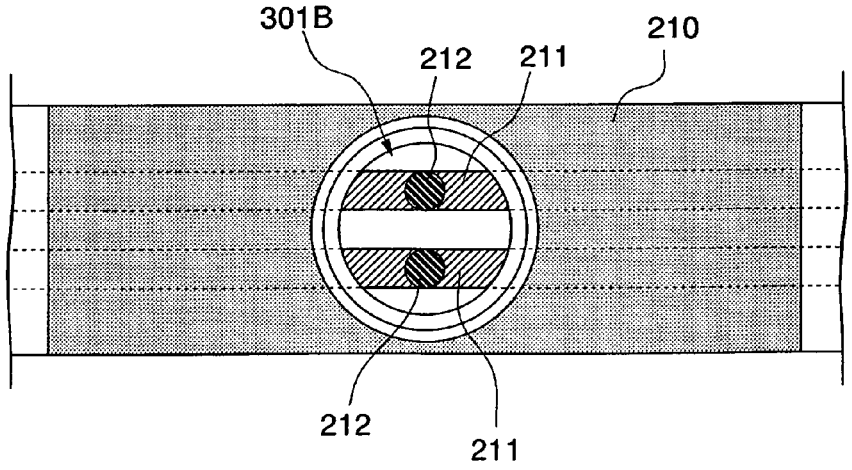

FIGS. 23A and 23B illustrate an example of the structure of the connecting portions between the assemblies and the hook-and-loop fasteners. FIGS. 23A and 23B illustrate the structure of a portion X in FIG. 21, that is, the structure of the connecting portion between the assembly 200 and the hook-and-loop fastener 210. FIG. 23A is a sectional view thereof, and FIG. 23B is a plan view of the connecting portion of the hook-and-loop fastener 210. As illustrated in FIGS. 23A and 23B, a hook-and-loop fastener 300 is affixed to the lower surface of the assembly 200, and a male type connector portion 301A is formed at the center thereof. At the distal end of the connector portion 301A, there is formed a conductive portion 303, to which wiring 302 is connected, with the wiring 302 being connected to an electronic circuit in the assembly 200.

On the side of the hook-and-loop fastener 210 connecting the assemblies, there is formed a female type connector portion 301B to which the male type connector portion 301A formed on the hook-and-loop fastener 300 on the assembly 200 side is attached. A conductive portion 212 is formed at the bottom of the female type connector portion 301B, and wiring 211 is connected to the conductive portion 212. When connecting the assemblies by the hook-and-loop fasteners, the wiring 211 is connected so as to attain electrical conduction by the two hook-and-loop fasteners.

By attaching the male type connector portion 301A formed on the hook-and-loop fastener 300 on the assembly 200 side to the female type connector portion 301B of the hook-and-loop fastener 210, the assembly 200 and another assembly are electrically connected to each other via the wiring of the hook-and-loop fastener 210.

Figure 24A:
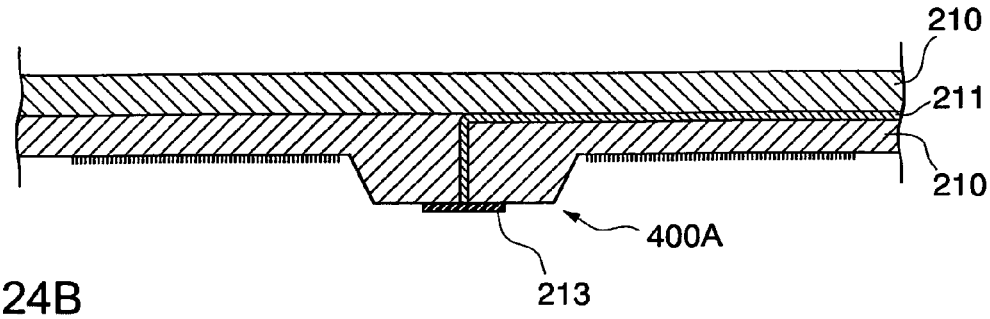
FIGS. 24A through 24C are sectional views and a plan view illustrating an example of construction of a connecting portion between hook-and-loop fasteners.
Figure 24B:
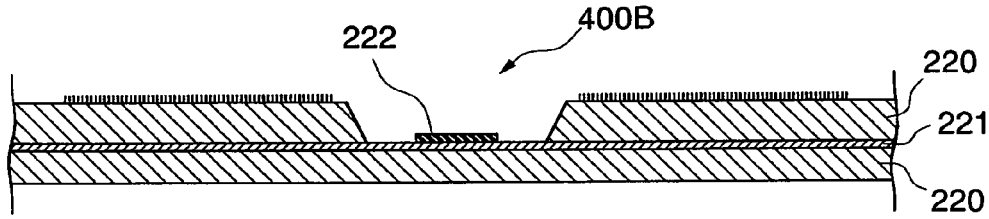
Figure 24C:
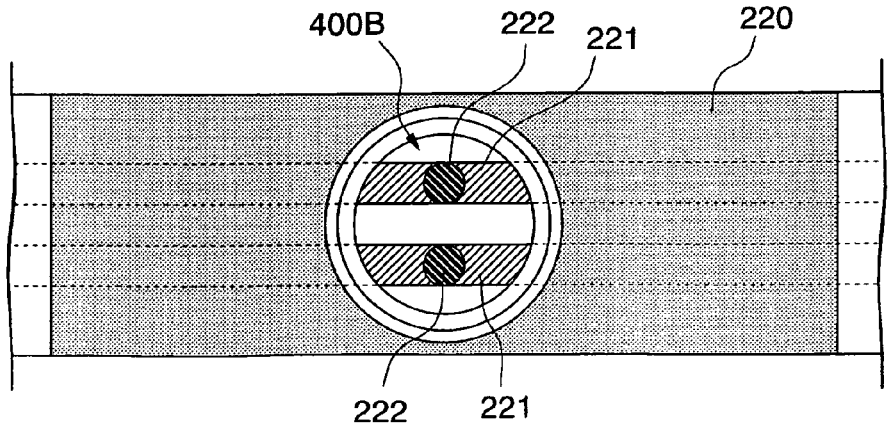
Figure 25:
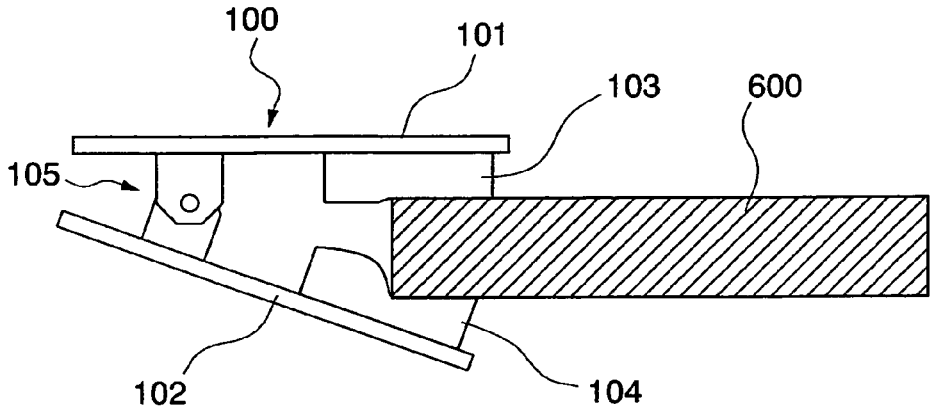
Fig.25 Prior Art
FIG. 25 is an explanatory view illustrating an example of a state in which a part of the instrument is grasped by a clip of a clip-type tuner.
Figure 26:
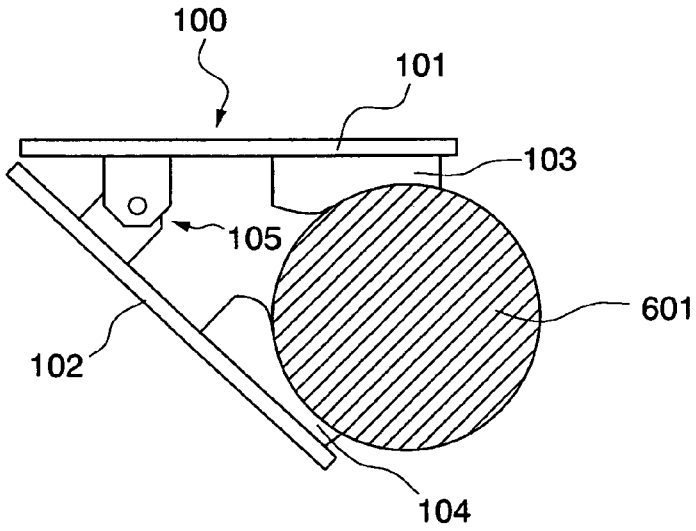
Fig.26 Prior Art
FIG. 26 is an explanatory view illustrating another example of the state in which a part of the instrument is grasped by the clip of the clip-type tuner.
Figure 27:
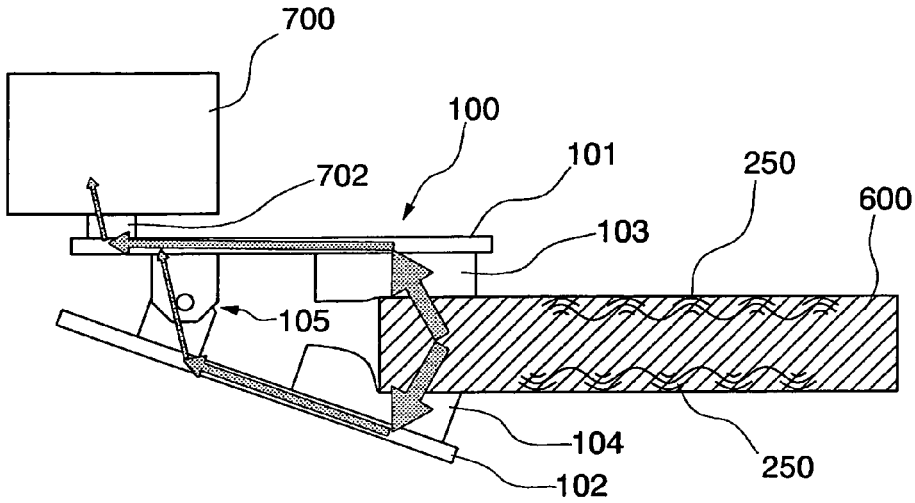
Fig.27 Prior Art
FIG. 27 is a schematic explanatory view illustrating construction of a tuner constructed such that the tuner main body is connected to the clip through an intermediation of a connecting portion including a joint mechanism.
Figure 28:
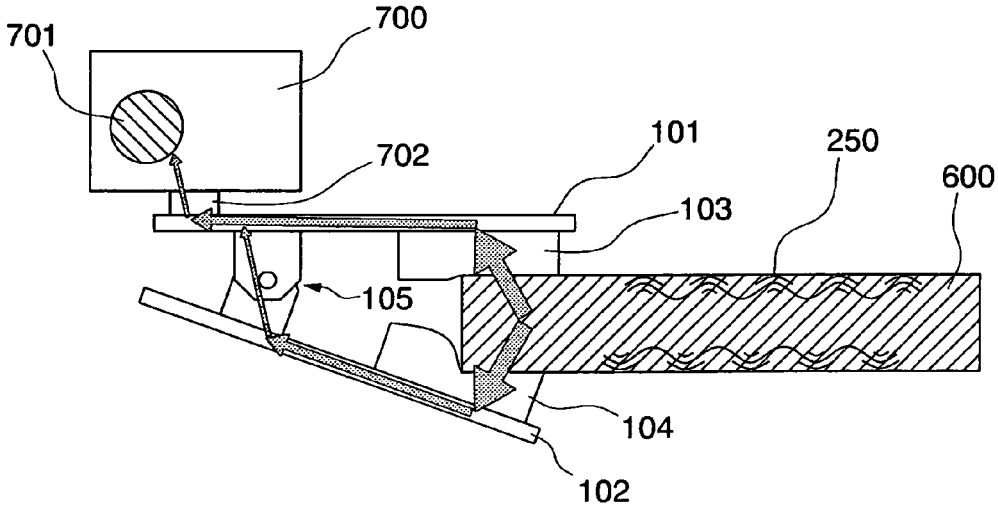
Fig.28 Prior Art
FIG. 28 is an explanatory view illustrating how vibration generated from the instrument is propagated to a vibration sensor contained in the tuner main body via the clip.

FIGS. 24A through 24C illustrate the structure of a portion Y in FIG. 21, that is, the structure of the connecting portion between the hook-and-loop fastener 210 and the hook-and-loop fastener 220. FIG. 24A is a sectional view of the structure of the connecting portion of the hook-and-loop fastener 210, FIG. 24B is a sectional view of the structure of the connecting portion of the hook-and-loop fastener 220, and FIG. 24C is a plan view of the connecting portion of the hook-and-loop fastener 220. As illustrated in FIGS. 24A through 24C, a male type connector portion 400A is formed on the back surface of the hook-and-loop fastener 210, and a conductive portion 213 is formed at the distal end of the male type connector portion 400A.

Further, on the surface of the hook-and-loop fastener 220, there is formed a female type connector portion 400B to which the male type connector portion 400A is attached. At the bottom of the female type connector portion 400B, there is formed a conductive portion 222, and wiring 221 is connected to the conductive portion 222.

By attaching the male type connector portion 400A formed on the hook-and-loop fastener 210 to the female type connector portion 400B of the hook-and-loop fastener 220, the hook-and-loop fastener 210 and the hook-and-loop fastener 220 are electrically connected to each other. The other hook-and-loop fasteners are connected together by similar structure to thereby attain electrical connection.

In this way, the functional portions of the tuner are formed as a plurality of independent assemblies, and the plurality of assemblies are connected to each other while being electrically connected by conductive hook-and-loop fasteners to thereby fix the tuner to the instrument by hook-and-loop fasteners, and hence it is possible to individually replace the functional portions of the tuner, making it possible to easily build a system meeting the needs of the user.

Tenth Embodiment

Figure 22:
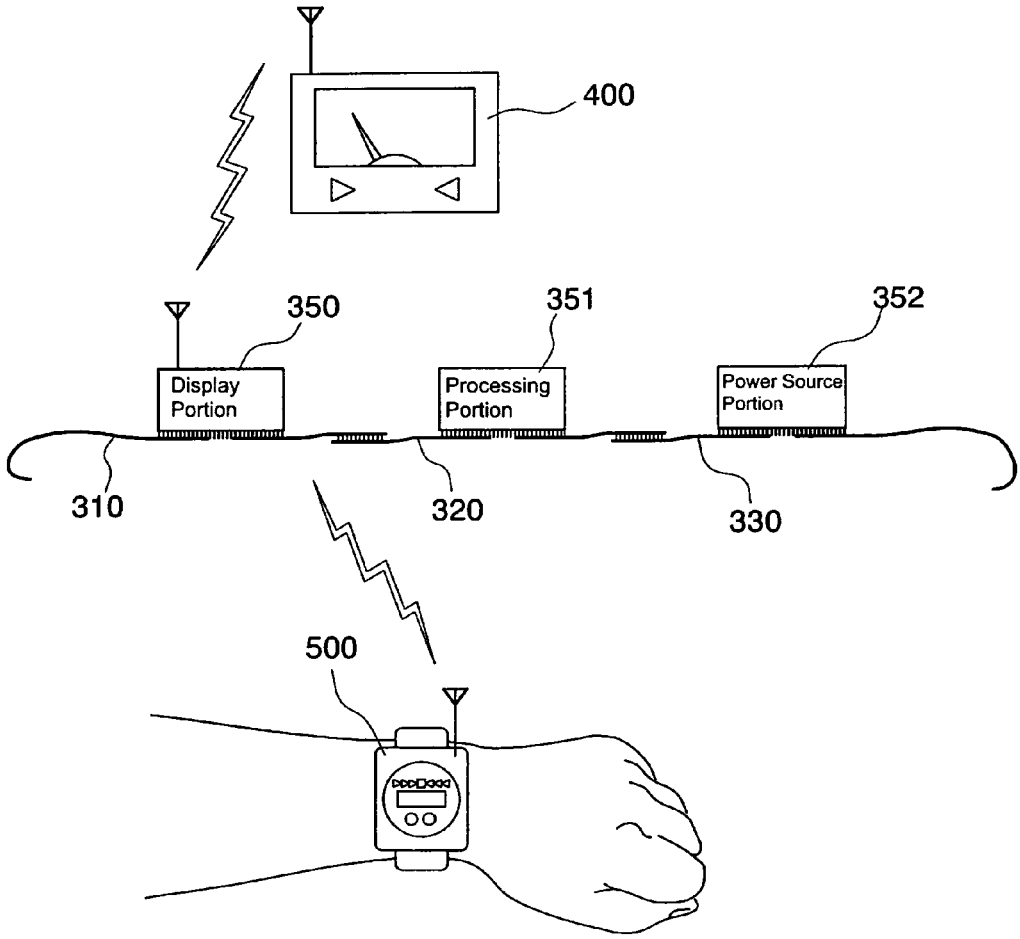
FIG. 22 is a diagram illustrating construction of a tuner mounting device according to a tenth embodiment of the present invention.

Next, FIG. 22 illustrates construction of a tuner mounting device of a tenth embodiment of the present invention. As illustrated in FIG. 22, in the tuner mounting device of the tenth embodiment of the present invention, the tuner has on the outside a display portion 400 having a radio communication function.

The functional portions forming the tuner except for the display portion form, for example, a communication portion 350, a processing portion 351, and a power source portion 352 as a plurality of independent assemblies.

Of the plurality of assemblies 350, 351, and 352, the assembly 350 has a radio communication function, and the plurality of assemblies 350, 351, and 352 are connected together while being electrically connected to each other by conductive hook-and-loop fasteners 310, 320, and 330, with the assemblies being fixed to the instrument in the connected state by those hook-and-loop fasteners.

The communication portion 350 has a function to transmit data indicating the instrument tuning condition by radio communication to an external display portion (desktop type) 400 or a wristwatch type display portion 500 having a radio communication function.

The display portion 400, 500 receives data indicating the instrument tuning condition from the communication portion 350, and displays the instrument tuning condition.

As a result, it is possible to display the instrument tuning condition on an external display means having a radio communication function.

What is claimed is:

1. A tuner mounting device for mounting a tuner to an instrument, comprising: a hook-and-loop fastener that connects to a main body of the tuner and is configured to wrap directly around at least a part of the instrument so that end portions of the hook-and-loop fastener are removably connected to one another to directly mount the tuner main body to the part of the instrument.

2. A tuner mounting device according to claim 1; further comprising a vibration sensor contained in the tuner main body for detecting vibrations generated through operation of the instrument when the tuner main body is mounted to the part of the instrument by the tuner mounting device.

3. A tuner mounting device according to claim 1; further comprising a vibration sensor mounted directly on the hook-and-loop fastener for detecting vibrations generated through operation of the instrument when the tuner main body is mounted to the part of the instrument by the tuner mounting device.

4. A tuner mounting device for mounting a tuner to an instrument, wherein a tuner main body containing a vibration sensor for detecting vibration generated through operation of the instrument is placed on an upper surface of a part of the instrument through an intermediation of a buffer material, and wherein, in this state, the tuner main body is fixed to the instrument so as to integrally surround and fasten the instrument and the tuner main body by a hook-and-loop fastener.

5. A tuner mounting device for mounting a tuner to be attached to an instrument, comprising:

a first hook-and-loop fastener that connects to a part of the instrument and that is configured to wrap around at least the part of the instrument; and a second hook-and-loop fastener that connects to a lower surface of a main body of the tuner containing a vibration sensor for detecting vibrations generated through operation of the instrument, the tuner main body being mounted to the part of the instrument by attachment of the first and second hook-and-loop fasteners to one another as the first hook-and-loop faster wraps around at least the part of the instrument.

6. A tuner mounting device for mounting a tuner to an instrument, comprising:

a mounting base portion;

a hook-and-loop fastener configured to wrap around a part of the instrument to connect the mounting base portion to the part of the instrument; and a connecting structure that connects to a lower surface of a main body of the tuner containing a vibration sensor for detecting vibration generated through operation of the instrument, the tuner main body being mounted to the part of the instrument by attachment of the connecting structure to the mounting base portion as the hook-and-loop fastener wraps around the part of the instrument.

7. A tuner mounting device for mounting a tuner to an instrument, wherein a mounting base portion for fixing a tuner main body to a part of the instrument is fixed to the instrument by a hook-and-loop fastener, with a structure to be fitted into the mounting base portion being provided on a lower surface of a tuner main body containing a vibration sensor for detecting vibration generated through operation of the instrument, wherein the mounting base portion has a power source portion and a power supply contact, with the structure having an electrical contact corresponding to the power supply contact provided on the mounting base portion, and wherein the tuner main body is fixed to the part of the instrument by attaching the structure to the mounting base portion, with power being supplied to an electronic circuit inside the tuner main body from the power source portion contained in the mounting base portion via the power supply contact and the electrical contact provided on the structure.

8. A tuner mounting device for mounting a tuner to an instrument, wherein a mounting base portion for fixing a tuner main body to a part of the instrument is fixed to the instrument by a hook-and-loop fastener, with a structure to be fitted into the mounting base portion being provided on a lower surface of the tuner main body, wherein the mounting base portion has a vibration sensor for detecting vibration generated through operation of the instrument and a vibration sensor signal contact, with the structure having an electrical contact corresponding to the vibration sensor signal contact provided on the mounting base portion, and wherein the tuner main body is fixed to a part of the instrument by attaching the structure to the mounting base portion, with the vibration sensor contained in the mounting base portion being connected to an electronic circuit inside the tuner main body via the vibration sensor signal contact and an electrical contact provided on the structure.

9. A tuner mounting device for mounting a tuner to an instrument, wherein a mounting base portion for fixing a tuner main body to a part of the instrument is fixed to the instrument by a hook-and-loop fastener, with a structure to be fitted into the mounting base portion being provided on a lower surface of the tuner main body, wherein the mounting base portion has a power source portion, a vibration sensor for detecting vibration generated through operation of the instrument, a power supply contact, and a vibration sensor signal contact, the structure having a first electrical contact corresponding to the power supply contact and a second electrical contact corresponding to the vibration sensor signal contact, and wherein the tuner main body is fixed to the part of the instrument by attaching the structure to the mounting base portion, and power is supplied to an electronic circuit inside the tuner main body from the power source portion contained in the mounting base portion via the first electrical contact provided on the structure, the vibration sensor being connected to the electronic circuit inside the tuner main body via the vibration sensor signal contact and the second electrical contact.

10. A tuner mounting device for mounting a tuner to an instrument, wherein a mounting base portion for fixing a tuner main body to a part of the instrument is fixed to the instrument by a hook-and-loop fastener through the intermediation of a material having stretchability, with a structure to be fitted into the mounting base portion being provided on a lower surface of the tuner main body, and wherein the tuner main body is fixed to a part of the instrument by attaching the structure to the mounting base portion.

11. A tuner mounting device for mounting a tuner to an instrument, comprising:

a plurality of conductive hook-and-loop fasteners configured for fastening to one another, each of the conductive hook-and-loop fastener having at least one conductive connecting portion electrically connecting the conductive hook-and-loop fasteners together when fastened to one another, the conductive connecting portions of the hook-and-loop fasteners being configured for electrical connection to respective functional portion assemblies of the tuner to place the functional portion assemblies in an electrically connected state in which the functional portion assemblies are electrically connected to one another, and the conductive hook-and-loop fasteners being configured for connection to the instrument to securely mount the functional portion assemblies of the tuner to the instrument in the electrically connected state of the functional portion assemblies.

12. A tuner mounting device for mounting a tuner to an instrument, comprising: a conductive hook-and-loop fastener that connects a plurality of independent functional portion assemblies of the tuner to one another in an electrically connected state in which the functional portion assemblies are electrically connected to one another, the conductive hook-and-loop fastener being configured for connection to the instrument to securely mount the functional portion assemblies of the tuner to the instrument in the electrically connected state of the functional portion assemblies of the tuner so that a communication portion having a radio communication function and corresponding to one of the functional portion assemblies of the tuner mounted to the instrument transmits, via radio communication, data indicating a tuning state of the instrument to an external display device of the tuner having a communication function.

13. A tuner mounting device according to claim 1;

wherein the hook-and-loop fastener is configured to completely wrap around at least the part of the instrument to which the tuner main body is mounted.

14. A tuner mounting device according to claim 1;

wherein the hook-and-loop fastener is configured to wrap around both the tuner main body and the part of the instrument to which the tuner main body is mounted.

15. A tuner mounting device according to claim 1;

wherein the hook-and-loop fastener is configured to completely wrap around both the tuner main body and the part of the instrument to which the tuner main body is mounted.

16. A tuner mounting device according to claim 5;

further comprising a third hook-and-loop fastener that connects to a rear surface of the tuner main body.

17. A tuner mounting device according to claim 6;

further comprising an accommodation structure that connects to a rear surface of the tuner main body and that is engageable with the mounting base portion to mount the tuner main body to the part of the instrument when the hook-and-loop fastener connects the mounting base portion to the part of the instrument.

18. In combination: a tuner having a main body configured for mounting to a portion of a musical instrument to indicate a tuning state of the musical instrument; and a hook-and-loop fastener that directly mounts the main body of the tuner to the portion of the musical instrument by wrapping around at least the part of the musical instrument.

19. A combination according to claim 18; wherein the hook-and-loop fastener directly mounts the main body of the tuner to the portion of the musical instrument by wrapping completely around the part of the musical instrument.

20. A combination according to claim 18; wherein the hook-and-loop fastener directly mounts the main body of the tuner to the portion of the musical instrument by wrapping completely around the part of the musical instrument and the main body of the tuner.

* * * * *